United States Patent [19]

Moertel

[11] 3,975,801

[45] Aug. 24, 1976

[54] SLIDE FASTENER STRINGER

[75] Inventor: George B. Moertel, Crawford, Pa.

[73] Assignee: Textron, Inc., Providence, R.I.

[22] Filed: Jan. 9, 1975

[21] Appl. No.: 539,643

[52] U.S. Cl. ..... 24/205.1 C; 24/205.16 C; 24/205.13 C

[51] Int. Cl.[2] ..... A44B 19/10; A44B 19/40

[58] Field of Search ..... 24/205.16 C, 205.13 C, 24/205.1 C

[56] References Cited

UNITED STATES PATENTS

| | | | |
|---|---|---|---|
| 1,581,751 | 4/1926 | Marinsky | 24/205.16 C |
| 3,162,918 | 12/1964 | Burbank | 24/205.13 C |
| 3,665,561 | 5/1972 | Heimberger | 24/205.16 C |
| 3,795,950 | 3/1974 | Sohr | 24/205.16 C |
| 3,831,228 | 8/1974 | Jakob | 24/205.16 C |
| 3,854,174 | 12/1974 | Yoshida | 24/205.16 C |
| 3,855,671 | 12/1974 | Fujisaki | 24/205.13 C |

FOREIGN PATENTS OR APPLICATIONS

| | | | |
|---|---|---|---|
| 709,551 | 5/1965 | Canada | 24/205.16 C |
| 1,940,734 | 2/1971 | Germany | 24/205.1 C |
| 575,938 | 4/1958 | Italy | 24/205.13 C |

*Primary Examiner*—Bernard A. Gelak

[57] ABSTRACT

A stringer for a slide fastener has a coupling element formed from a continuous filament with superimposed leg portions and an attaching member. An elongated flexible member extending parallel the attaching member and between the superimposed leg portions is gripped by a groove, a tooth, or the like formed on one leg portion of each pair of leg portions to restrain longitudinal and transverse movement of the leg portions relative to the elongated member. Thread means secures the coupling element and elongated member to one side of the tape by extending over the elongated member or over the one leg portion only between the superimposed leg portions. The elongated member provides dimensional stability to the coupling element.

16 Claims, 15 Drawing Figures

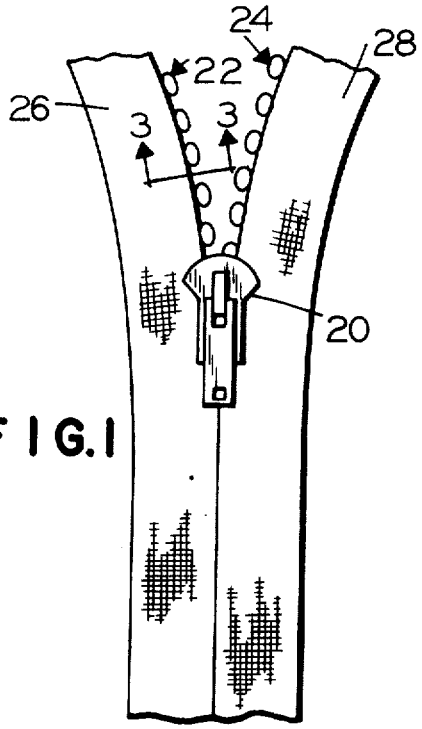
FIG. 1
FIG. 3
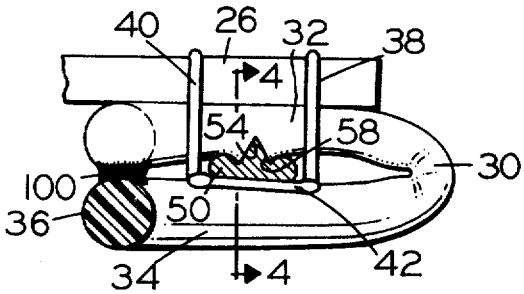
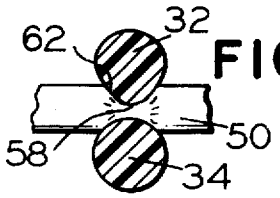
FIG. 4
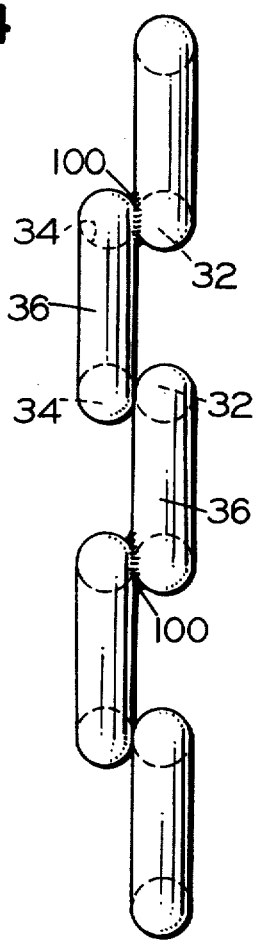
FIG. 5
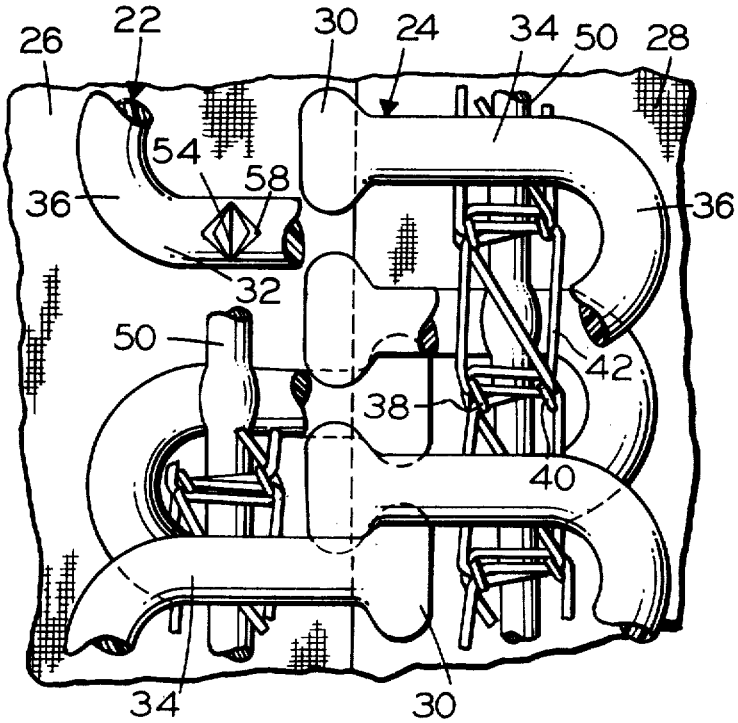
FIG. 2

FIG. 10
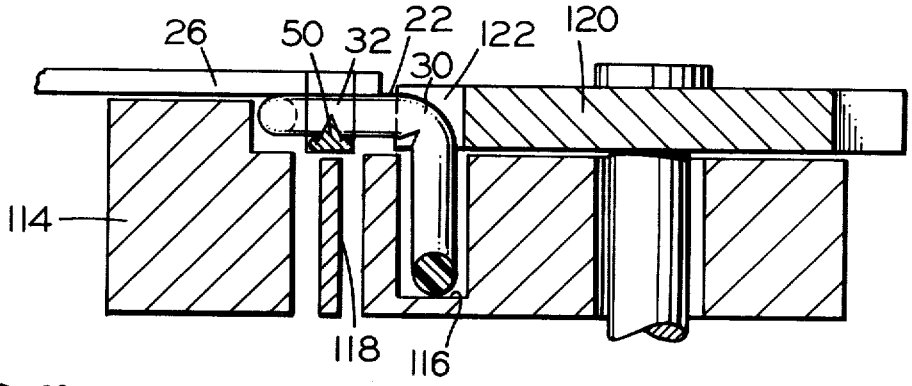
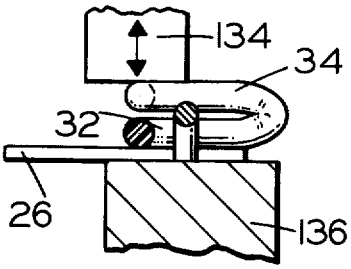
FIG. 11
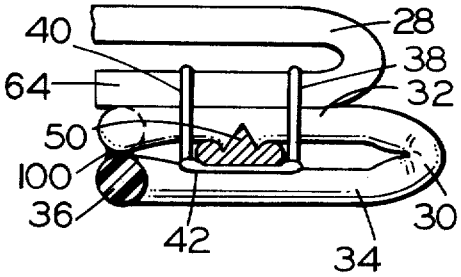
FIG. 12
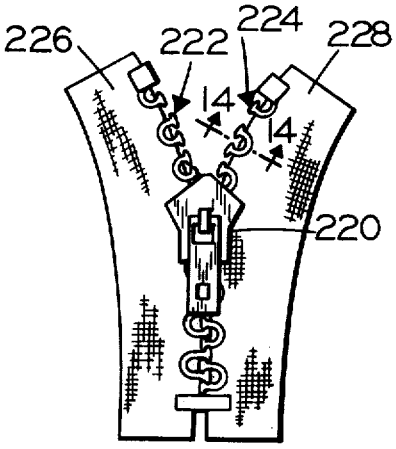
FIG. 13
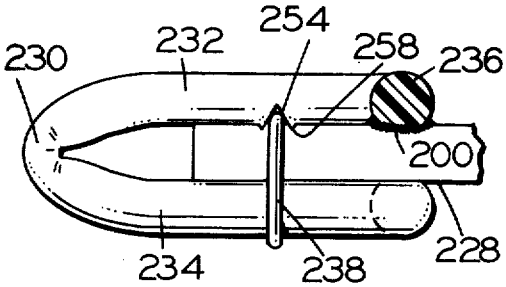
FIG. 14
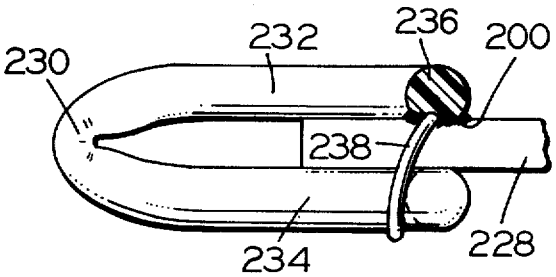
FIG. 15

SLIDE FASTENER STRINGER

BACKGROUND OF THE INVENTION

1. Field of the Invention

The invention relates to slide fasteners and to their method and apparatus of manufacture wherein the slide fastener has coupling elements formed from continuous filamentary materials secured to the adjoining edges of openings for opening and closing the openings.

2. Description of the Prior Art

The prior art, as illustrated in U.S. Pat. Nos. 3,359,604, 3,422,503, 3,588,967, 3,665,561, 3,691,599, 3,757,391, and German Pat. No. 2,133,310, contains a number of slide fasteners employing coupling elements, such as continuous coupling elements formed from monofilaments with leg portions attached to one or both sides of tapes. Some of the prior art slide fasteners depend upon the tapes to provide longitudinal and/or transverse dimensional stability to the coupling elements; such prior art slide fasteners employing relatively heavy or strong and dimensionally stable tapes for supporting the filamentary coupling elements which degrade the appearance or flexibility of garments formed from relatively sheer materials, knitted materials, and the like. Other prior art slide fasteners have threads attaching the coupling elements to the tapes wherein the threads pass over exposed portions of the coupling elements which subjects the exposed threads to wear from sliders moving over the coupling elements.

SUMMARY OF THE INVENTION

The invention is summarized in that a stringer for a slide fastener includes a tape-like attachment portion; a coupling element disposed along one edge of the attachment portion and being formed from a continuous filament into successive coupling sections; each section having a head portion, a pair of elongated leg portions extending from opposite sides of the head portion, and a connecting portion interconnecting to a leg portion of an adjoining section; both of said pair of leg portions of each section extending over one side of the attachment portion adjacent to one edge of the attachment portion with one of the pair of leg portions engaging the attachment portion; an elongated member extending parallel to the attachment portion throughout the length of the coupling element between the pair of leg portions of each section and maintaining the pair of leg portions of each section in spaced relationship; thread means passing through the attachment portion and around at least one of the elongated member and the one leg portion of each section for securing each section to the one side of the attachment portion, the outward surface of the other leg portion of each section being free of the securing thread means; said pair of leg portions of each section being disposed against the elongated member; and means formed on a leg portion of the pair of leg portions of each section and engaging the elongated member for restraining longitudinal and transverse movement of each section relative to the elongated member.

An object of the invention is to construct a stringer for a slide fastener having a continuous filamentary coupling element which does not require a dimensionally stable support tape.

Another object of the invention is to construct a stringer for a slide fastener wherein a continuous filamentary coupling element is secured to a supporting member in a manner producing substantially increased crosswise strength of the slide fastener.

Still another object of the invention is to provide a continuous filamentary coupling element interlocked with an internal elongated member in a slide fastener for stabilizing the longitudinal dimensions of the coupling element.

It is also an object of the invention to construct a fastener wherein elongated members within interlocking continuous filamentary coupling elements impart longitudinal and transverse strength to the coupling elements to enhance crosswise strength while improving flexibility.

An advantage of the invention is that threads securing a coupling element of a slide fastener to a tape do not pass over exposed surfaces of the coupling element, thus reducing failure of the stringer due to wear of attaching threads by a slider.

One feature of the present invention is that one of a pair of superimposed leg portions of a continuous filamentary coupling element is provided with a tooth, groove, or the like, which grips or mechanically interlocks with a resilient elongated member interposed between the leg portions to form a dimensionally stable coupling element.

Other objects, advantages and features of the invention will be apparent from the following description taken in conjunction with the accompanying drawings.

BRIEF DESCRIPTION OF THE DRAWINGS

FIG. 1 is a plan view of a slide fastener in accordance with the invention.

FIG. 2 is a bottom view of a portion of a chain of the slide fastener of FIG. 1.

FIG. 3 is a cross-sectional view taken along line 3—3 of FIG. 1.

FIG. 4 is a section view taken along line 4—4 of FIG. 3.

FIG. 5 is a side view of a coupling element of the slide fastener of FIG. 1.

FIG. 10 is a detail cross-sectional view of another portion of the apparatus of FIG. 6.

FIG. 11 is a cross-sectional view of still another portion of the apparatus of FIG. 6.

FIG. 12 is a cross-sectional view similar to FIG. 3 of a variation of the slide fastener.

FIG. 13 is a plan view of a modified slide fastener.

FIG. 14 is a cross-sectional view taken along line 14—14 of FIG. 12.

FIG. 15 is a cross-sectional view similar to FIG. 14 of a further modified slide fastener.

DESCRIPTION OF THE PREFERRED EMBODIMENT

Figure 6:
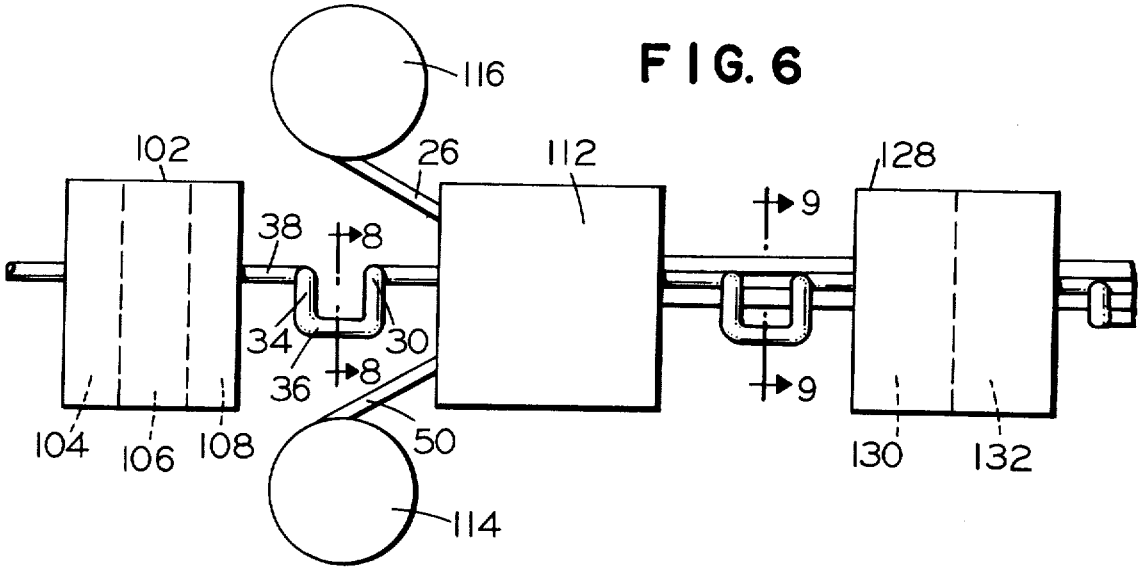
FIG. 6 is a diagram of an apparatus for manufacturing the stringer for the slide fastener of FIG. 1.

As illustrated in FIG. 1, the present invention is embodied in a slide fastener including a slider 20 mounted for sliding movement along coupling elements indicated generally at 22 and 24 disposed along adjacent edges of respective attachment portions of planarly disposed tapes 26 and 28. The element 22 and the tape 26 form a left stringer while the element 24 and the tape 28 form a right stringer. The coupling elements 22 and 24 are capable of closing and opening with each other in response to movement of the slider 20.

As shown in FIG. 2, each of the coupling elements 22 and 24 is formed from a continuous filament, such as a polyester or nylon monofilament, into successive coupling sections each of which includes a head portion 30, an upper leg portion 32, a lower leg portion 34, and a connecting or heel portion 36 interconnecting leg portions of the adjoining sections. The leg portions 32 and 34 of each section extend from respective upper and lower ends of the head portion 30 and are superimposed such that they extend parallel in a respective plane perpendicular to the adjoining edges of the tapes 26 and 28. As illustrated in FIGS. 2 and 3, the leg portions 32 and 34 of each coupling element 22 and 24 extend over one side of the respective tapes 26 and 28 contiguous the adjacent edges of the tapes 26 and 28 and are secured to the tapes by threads such as needle threads 38 and 40 and looper threads 42.

The coupling elements 22 and 24 are the ladder type such as the meander ladder type shown in FIGS. 1, 2 and 3. In the meander ladder type the connecting portions 36 of alternate sections extend in respective spaced planes parallel the tapes 26 and 28 and alternatively interconnect upper leg portions 32 and lower leg portions 34 which also extend in the respective spaced planes parallel the tapes 26 and 28.

As shown in FIGS. 2, 3 and 4, an elongated member 50 having a generally round cross section extends between the leg portions 32 and 34 longitudinally in each of the coupling elements 22 and 24 parallel to the tapes 26 and 28 and spaced from the connecting portions 36. The elongated members 50 are formed from material, such as a textile material, which is substantially more resilient or deformable in cross section than the filamentary material of the coupling elements 22 and 24. The elongated members 50 are further selected to have a predetermined longitudinal dimensional stability or elasticity.

The leg portion 32 of each section has a detent or groove 54 and teeth or projections 58 formed by upset grooving the surface of the leg portion 32 facing the leg portion 34 midway between the ends of the leg portion 32. The groove 54 is formed perpendicular to the longitudinal dimension of the leg portion 32 and extends parallel the elongated members 50. The leg portions 32 and 34 are biased toward each other such that the elongated members 50 are engaged and distorted and resiliently deformed so that the portions of the elongated members 50 engaged by the leg portions 32 are conformed to the topography of the surface portions in and around the grooves 54. The teeth 58 displace portions of the elongated members 50 to interlock therewith. The grooves 54 have V-shaped cross sections which have an area substantially less than the cross-sectional area of the elongated flexible members 50 such that the members 50 are distorted inward by the walls of the grooves 54 to form abutment portions 62 engaging and interlocking with the sides of the leg portions 32 and 34 at the ends of the grooves 52. The grooves 54 and the teeth 58 have relatively sharp edges for gripping and biting into the elongated flexible members 50. Planar surfaces forming sides of the grooves 54 and sides of the teeth 58 engage a substantial surface portion of the members 50 to form a wall tending to prevent movement of the elongated members 50 in a direction longitudinal of the leg portions 32 and 34.

The looper thread 42 at each coupling section extends over both the leg portion 32 and the elongated member 50 and passes between the leg portions 32 and 34. The outward-facing or bottom surfaces of all the leg portions 34 are free of the looper thread 42. The looper thread 42 at each coupling section also extends between the leg portion 34 and the member 50 and is gripped therebetween.

As shown particularly in FIGS. 3 and 5, alternate overlapping parts of the leg portions 32 and 34 adjacent the heel portions 36 of alternate sections are bonded together by a threadless bond 100. The threadless bond may be an adhesive bond, an ultrasonic bond, a bond formed by heat sealing the overlapping parts together, or the like. Leg portions of sections between the alternate sections having bonded leg portions are not bonded together so as to allow relative movement between the portions adjacent the connecting portions 36.

In operation of the slide fastener of FIG. 1, the slider 20 bends the coupling elements 22 and 24 in the plane of the tapes 26 and 28 to open the spacing between the head portions 30 at the bends within the slider 20 to allow interengagement or disengagement of the head portions 30 of the coupling elements 22 and 24 to close or open the slide fastener by movement of the slider 20.

The elongated members 50 having deformed portions interlocking with the grooves 54 and the teeth 58 on the leg portions 32 maintain the longitudinal spacing between the leg portions of adjacent sections. The resilience of the elongated members 50 allows controlled pivotal, transverse, and longitudinal elastic movement of the leg portions 32 and 34 relative to the elongated members 50 and each other where the coupling elements 22 and 24 are bent by the slider 20; this ensures easy and reliable operation.

The spacing between the elongated members 50 and the connecting portions 36 and the longitudinal dimensional stability of the members 50 results in cooperating between the members 50 and portions 36 to maintain the coupling elements 22 and 24 generally straight and to control head-to-head skew without substantially degrading the flexibility of the coupling elements 22 and 24. The central location of the members 50 allows greatly improved flexibility of the slide fastener since tapes having stiffness or resistance to transverse bending can be eliminated or replaced by more flexible tapes. Further, the elimination of the necessity of strong tapes can reduce curvature of the fasteners due to torque of the tapes on the coupling elements.

Longitudinal and transverse forces applied to the head portions 30 by crosswise stress on the slide fasteners is distributed and transferred by the elongated members 50 both between the leg portions 32 and 34 of each section and between the leg portions of the adjoining sections; such distribution increasing the crosswise strength of the slide fastener.

The elongated members 50 provide the function normally associated with the carrier tapes of prior art slide fasteners. Thus, the necessity of carrier tapes providing longitudinal and transverse dimensional stability to the slide fastener is eliminated. Attaching portions or tapes 26 and 28 for the slide fasteners can be knitted materials, relatively sheer materials, edge portions of the garment seam, or the like, which do not offer any substantial stability to the coupling elements 22 and 24; thus, the attaching portions 26 and 28 can be selected to avoid degrading the appearance of the garment without deteriorating slide fastener strength and performance.

Having the looper threads 42 and the needle threads 38 and 40 not passing over an exposed portion of the coupling elements 22 and 24 avoids wear by the slider 20 upon the attaching thread means. Such arrangement of threads passing only over the leg portion 32 with the outward-facing surfaces of the leg portion 34 free of threads is made possible by the bond 100 formed between leg portions of alternate sections of the coupling elements 22 and 24. Further, having the looper thread 42 gripped between the elongated member 50 and the leg portion 34 prevents the unraveling thereof at the end of a stringer or in the event of breakage.

Figure 7:
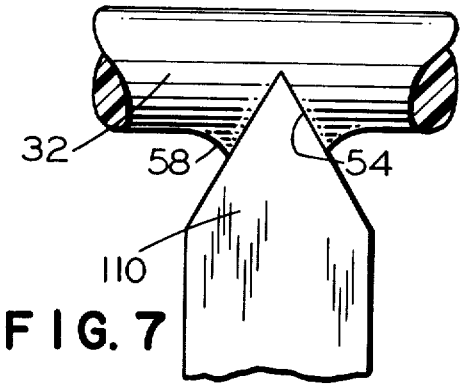
FIG. 7 is a detail view of the portion of the apparatus of FIG. 1.
Figure 8:
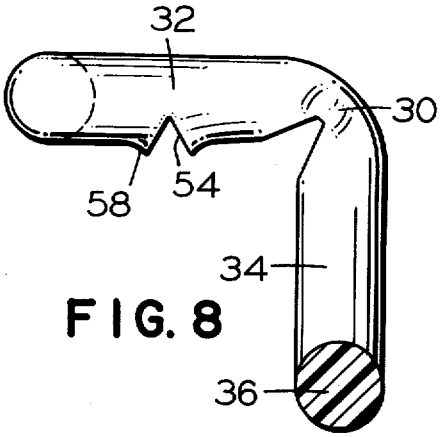
FIG. 8 is a cross-sectional view taken along line 8—8 of FIG. 6.

An apparatus and method for manufacturing the stringers of the slide fasteners of FIG. 1 is illustrated in FIG. 6 wherein the apparatus includes a mechanism 102 for forming a continuous filament into a meander-shaped coupling element having an L-shaped cross-sectional configuration, shown in FIG. 8, wherein the leg portions 32 and 34 extend generally at right angles to each other from the head portion 30. The mechanism 102 includes means 104 for bending the filament into the meander shape and forming the head portions 30, means 106 for forming the grooves 54 and teeth 58 in the leg portions 32, and means 108 for bending the coupling element into the L-shaped cross-sectional configuration. The means 106, as illustrated in FIG. 7, includes a V-shaped chisel point 110 for engaging each leg portion 32 to upset groove the surface of each leg portions 32 to form the grooves 54 and the teeth 58. The means 104, 106 and 108 may be combined in a single mechanism or may be separate.

Figure 9:
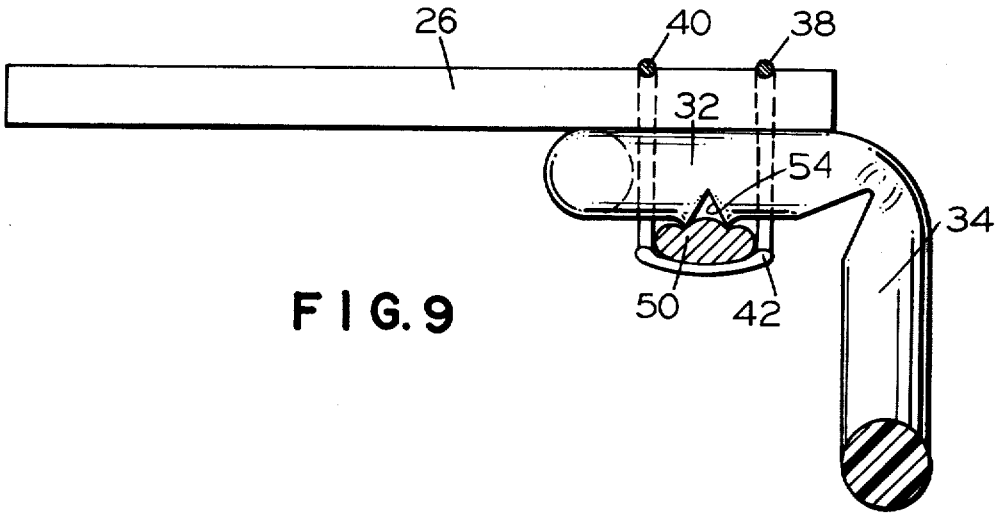
FIG. 9 is a cross-sectional view taken along line 9—9 of FIG. 6.

A sewing mechanism 112 for suitably receiving the coupling element formed into the L-shaped cross-sectional configuration along with the elongated member 50 from a supply 114 and the tape 26 from a supply 116 is a conventional apparatus, to which guiding facilities as shown in FIG. 10 have been added for applying a pair of needle threads 40 and 38 through the tape 26 and interlocking the needle threads 38 and 40 with the looper thread 42 passing over the elongated member 50 and the leg portions 32 as shown in FIG. 9. The guiding facilities include a member 114 with an L-shaped groove 116 for guiding the coupling element 22 with the L-shaped cross-sectional configuration through the sewing apparatus in juxtaposition to the tape 26. A portion 118 of the guide member 114 is positioned to suitably guide the elongated member 50 against the leg portion 32 aligned with the groove 54. A rotatable wheel 120 in the sewing mechanism 112 for being driven in synchronism with rest of the sewing apparatus 112, has spaced teeth 122 for engaging the successive sections of the coupling element 22 to synchronize the movement of the coupling element 22 along with the tape 26 and the operation of the sewing apparatus so as to properly position the needle threads 38 and 40 between the leg portions 32.

The apparatus of FIG. 6 also includes a mechanism 128 including means 130 for bending the leg portions 32 and 34 together and bonding means 132 for bonding alternate pairs of leg portions together. The bonding means 132, illustrated in FIG. 11, includes an ultrasonic bonding head 134 for engaging alternate leg portions 34 to bond the alternate leg portions 34 to corresponding leg portions 32 which are supported along with the tape 26 on an anvil 136.

In operation of the apparatus and performance of the method illustrated in FIGS. 6 through 11, a continuous filament is formed into a meander-shaped coupling element having an L-shaped cross-sectional configuration by the mechanism 102. The grooves 54 and teeth 58 are formed in the leg portion 32 by the means 106. The coupling element with leg portion 32 and 34 at right angles to each other is sewn to the tape 26 together with the elongated member engaging the grooves 54 of the leg portion 32 in the sewing mechanism 112. The coupling element is then bent at the head portion 30 to make the leg portions 34 to be about parallel to and superimposed with leg portions 32. Leg portions 32 and 34 of alternate sections of the coupling element are bonded together at 100 by the means 132 to bias the elongated member against the grooves 54 and teeth 58 such as to interlock therewith.

The chisel 110 simultaneously forms the grooves 54 and teeth 58 in the means 106. In the sewing mechanism 112, the teeth 122 feed the coupling element through the groove 116 together with the elongated member 50 guided by portion 118 through the stitching station where the needle threads 38 and 40 and the looper thread 42 are secured over the elongated member and leg portions 32 through the tape 26. The elongated member 50 can be very easily inserted and secured along with the leg portions 32 to the tape 26 while the leg portions 34 are still bent away from the leg portions 32. In the means 132, the ultrasonic bonding head 134 welds leg portions 34 in alternate sections of the coupling element together.

A modification of the slide fastener, shown in FIG. 12, has parts identified by numerals used to identify parts in FIGS. 1–5 indicating that such parts have similar structure and/or function. In the modification of FIGS. 12, the attachment portion of tape 28 is folded to form an underneath folded portion 64 to which the coupling element 24 is attached by the threads 38, 40 and 42. Thus, the adjacent edges of tapes of slide fasteners employing the modification of FIG. 5 are folded and hide the coupling elements to produce the appearance of a sewn garment seam.

A further modified slide fastener, shown in FIGS. 13 and 14, has a slider 220 mounted for sliding movement along coupling elements indicated generally at 222 and 224 disposed along adjacent edges of respective attachment portions of tapes 226 and 228. Each of the coupling elements 222 and 224 is formed from a continuous filament into successive coupling sections each of which include a head portion 230, leg portions 232 and 234 extending from opposite ends of the head portion 230, and a connecting or heel portion 236 interconnecting to a leg portion of an adjoining section. The leg portions 232 and 234 of the coupling element 224 extend over opposite sides of the tape 228 with the heel portion 236 of alternate sections being on opposite sides of the tape to connect leg portions 232 and 234, respectively. Only the leg portions 234 are secured to the tape 228 by threads 238 with the outward-facing surfaces of the leg portions 232 being free of threads. The leg portions 232 at the heel portion 236 are bonded by a bond 200 to the tape 228. The bond 200 may be an adhesive bond, or the bond 200 may be formed between thermoplastic threads of the tape 228 and the filament forming the coupling element 224 by ultrasonic bonding, thermal bonding or the like. The leg portion 232 has a groove 254 formed therein by upsetting to form teeth 258. The groove 254 is aligned with the threads 238 to secure the threads 238 relative to the tape 228. Additionally, the teeth 258 engage or bite into the tape 228 to further secure and locate the position of the leg portion 232 relative to the tape 228.

Having the threads 238 pass only over one leg portion 234 and being gripped or squeezed within the groove 232 beneath the other leg portion 232 presents substantially less surface portion of the thread 238 to movement of the slider 220 which tends to reduce and eliminate wear and breakage of the threads 238.

Also, having the groove 254 interlocking with the threads 238 and having the teeth 258 interlocking with the tape 238 substantially increases the strength of the attachment of the leg portions 232 and 234 to the edge of the tape 228 which substantially increases the crosswise strength of the slide fastener.

A still further modified slide fastener, illustrated in FIG. 15, has parts identified by the same numbers used to identify parts of the slide fasteners in FIGS. 13 and 14 indicating that such commonly identified parts have substantially similar structure and/or function. In the modified fastener of FIG. 14 the threads 238 are initially applied through the tape 228 and the tape 228 is then pulled to the right beneath the leg portion 232 to where the bond 200 is to be formed. Then, the bond 200 is formed over the threads 238 to secure the threads 238 in a relative position to the tape 228. This aids in preventing unraveling of the threads 238 at the end of the stringer or upon breakage of the thread over one leg portion 234 of a stringer as well as improving slide fastener crosswise strength.

Since many modifications, changes in detail, and variations can be made to the described embodiments, it is intended that all matter in the foregoing description and accompanying drawings be interpreted as illustrative and not in a limiting sense.

What is claimed is:

1. A stringer for a slide fastener comprising a tape-like attachment portion;

a coupling element disposed along one edge of the attachment portion and being formed from a continuous filament into successive coupling sections;

each section having a head portion, a pair of elongated leg portions extending from opposite sides of the head portion, and a connecting portion interconnecting to a leg portion of an adjoining section;

both of said pair of leg portions of each section extending over one side of the attachment portion adjacent the one edge of the attachment portion with one of the pair of leg portions engaging the attachment portion;

an elongated member extending parallel to the attachment portion longitudinally throughout the length of the coupling element and transversely between the pair of leg portions of each section such as to maintain the pair of leg portions of each section in spaced relationship;

thread means passing through the attachment portion and around at least one of the elongated member and the one leg portion of each section for securing each section to the one side of the attachment portion, the outward facing surface of the other leg portion of each section being free of the securing thread means;

said pair of leg portions of each section being disposed against the elongated member; and means including a sharpe edge formed on a leg portion of the pair of leg portions of each section and engaging the elongated member for restraining longitudinal and transverse movement of each section relative to the elongated member.

2. A stringer for a slide fastener as claimed in claim 1 wherein the means formed on a leg portion deforms a portion of the elongated member and interlocks with the deformed portion of the elongated member.

3. A stringer for a slide fastener as claimed in claim 1 wherein the means formed on a leg portion of each section includes a tooth projecting from a leg portion of each section and interlocking with the elongated member.

4. A stringer for a slide fastener as claimed in claim 1 wherein the means formed on a leg portion of each section includes a groove formed transversely in a leg portion of each section parallel the elongated member;

said elongated resilient member has a cross section which is resiliently deformable and substantially larger in area than the area of the cross section of each groove; and said elongated member is forced into the respective grooves by the opposite leg portion of each section whereby the elongated member is resiliently distorted such that the edges of the grooves form an interlock with the elongated member.

5. A stringer for a slide fastener as claimed in claim 4 wherein the cross section of each groove is V-shaped and the cross section of the elongated member is round.

6. A stringer for a slide fastener comprising a tape-like attachment portion;

a coupling element disposed along one edge of the attachment portion and being formed from a continuous filament into successive coupling sections;

each section having a head portion, a pair of elongated leg portions extending from opposite sides of the head portion, and a connecting portion interconnecting to a leg portion of an adjoining section;

both of said pair of leg portions of each section extending over one side of the attachment portion adjacent the one edge of the attachment portion with one of the pair of leg portions engaging the attachment portion;

an elongated member extending parallel to the attachment portion throughout the length of the coupling element between the pair of leg portion of each section and maintaining the pair of leg portions of each section in spaced relationship;

thread means passing through the attachment portion and around at least one of the elongated member and the one leg portion of each section for securing each section to the one side of the attachment portion, the outward facing surface of the other leg portion of each section being free of the securing thread means;

said pair of leg portions of each section being disposed against the elongated member;

means formed on a leg portion of the pair of leg portions of each section and engaging the elongated member for restraining longitudinal and transverse movement of each section relative to the elongated member;

said means formed on a leg portion of each section including a groove formed transversely in a leg portion of each section parallel the elongated member;

said elongated resilient member having cross section which is resiliently deformable and substantially larger in area than the area of the cross section of each groove;

said elongated member being forced into the respective grooves by the opposite leg portion of each section whereby the elongated member is resiliently distorted such that the edges of the grooves form an interlock with the elongated member; and further said means formed on a leg portion of each section including a pair of teeth projecting from a leg portion of each section at each side of the groove and interlocking with the elongated member.

7. A stringer for a slide fastener as claimed in claim 1 wherein the thread means includes a pair of needle threads and a looper thread extending over both the one leg portion and at least a portion of the elongated member.

8. A stringer for a slide fastener comprising a tape-like attachment portion;

a coupling element disposed along one edge of the attachment portion and being formed from a continuous filament into successive coupling sections;

each section having a head portion, a pair of elongated leg portions extending from opposite sides of the head portion and a connecting portion interconnecting to a leg portion of an adjoining section;

both of said pair of leg portions of each section extending over one side of the attachment portion adjacent the one edge of the attachment portion with one of the pair of leg portions engaging the attachment portion;

an elongated member extending parallel to the attachment portion throughout the length of the coupling element between the pair of leg portions of each section and maintaining the pair of leg portion of each section in spaced relationship;

thread means passing through the attachment portion and around at least one of the elongated member and the one leg portion of each section for securing each section to the one side of the attachment portion, the outward facing surface of the other leg portion of each section being free of the securing thread means;

said pair of leg portions of each section being disposed against the elongated member;

means formed on a leg portion of the pair of leg portions of each section and engaging the elongated member for restraining longitudinal and transverse movement of each section relative to the elongated member;

said coupling element being a meander-type element with the connecting portions of alternate sections extending in respective spaced planes parallel the attachment portion and with the leg portions of each pair of leg portions extending in the respective spaced planes, and selected pairs of leg portions having overlapping portions welded together adjacent the connecting portions.

9. A stringer for a slide fastener as claimed in claim 8 wherein only the overlapping portions of alternate pairs of leg portions are welded together.

10. A slide fastener comprising a pair of stringers and a slider on the stringers for opening and closing the stringers wherein each stringer includes a tape;

a meander-type coupling element disposed along one edge of the tape and being formed from a continuous filament into successive coupling sections;

each section having a head portion, a pair of elongated parallel leg portions extending from opposite sides of the head portion, and a heel portion interconnecting to a leg portion of an adjoining section;

both of said pair of leg portions extending in a plane perpendicular to the plane of the tape over a portion of one side of the tape adjacent to one edge of the tape with one of the pair of leg portions engaging the tape;

an elongated member being resilient in cross section and extending parallel to the attachment portion throughout the length of the coupling element between the pair of leg portions of each section for maintaining the pair of leg portions of each section in spaced relationship;

needle thread means extending through the tape;

looper thread means secured with the needle thread means and passing over the elongated member and the one leg portion between the pair of leg portions of each section to secure the one leg portion and the elongated member to the tape;

said one leg portion of each section having a groove formed therein for receiving a portion of the elongated member;

said groove in each one leg portion having a V-shaped cross section substantially less in area than the area of the cross section of the elongated member;

a pair of teeth projecting from the one leg portion of each section on the opposite sides of the groove;

said pair of leg portions of alternate sections being welded together at the heel portion to bias the pairs of leg portions against the looper thread means and the elongated member such that the elongated member is deformed by the teeth and into the grooves of the one leg portion to form an interlock between the elongated member and the one leg portion; and each of said teeth and respective sides of the respective grooves defining a planar surface engaging a substantial surface portion of the elongated member.

11. A stringer for a slide fastener comprising a carrier tape;

a meander-type coupling element disposed along one edge of the attachment portion and being formed from a continuous filamment into successive coupling sections;

each section having a head portion, a pair of elongated parallel leg portions extending from opposite sides of the head portion on opposite sides of the tape, and a heel portion interconnecting to a leg portion of an adjoining section;

said heel portions of alternate sections being on opposite sides of the tape;

thread means securing one leg portion of the pair of leg portions of each section to one side of the tape, the outward facing surface of the other leg portion of each section being free of the securing thread means;

the filament portion forming the other leg portion of the pair of leg portions and the corresponding heel portion on the other side of the tape being threadlessly bonded to the other side of the tape.

12. A stringer for a slide fastener as claimed in claim 11 including means securing the thread means to the inside of the other leg portion.

13. A stringer for a slide fastener as claimed in claim 12 wherein the means securing the thread means includes a groove formed in the other leg portion of each section for receiving the thread means.

14. A stringer for a slide fastener as claimed in claim 13 including a pair of teeth projecting from the other leg portion on opposite sides of the groove of each section for engaging the thread means and the tape.

15. A stringer for a slide fastener as claimed in claim 12 wherein the means securing the thread means includes a portion of the threadless bond between the other leg portion of each section and the other side of the tape.

16. A stringer for a slide fastener as claimed in claim 15 wherein the threadless bond is a welded bond.

* * * * *